US005995066A

United States Patent [19]

Muccioli et al.

[11] Patent Number: 5,995,066

[45] Date of Patent: Nov. 30, 1999

[54] ONE PIECE MAST POWER ANTENNA HAVING ELECTRICAL CONTACT WITH SLIDING AND DOCKING CONTACT PORTIONS

[75] Inventors: James P. Muccioli, Farmington Hills; James E. Van Hout, Auburn Hills, both of Mich.

[73] Assignee: Chrysler Corporation, Auburn Hills, Mich.

[21] Appl. No.: 08/877,885

[22] Filed: Jun. 18, 1997

Related U.S. Application Data

[60] Provisional application No. 60/020,414, Jun. 25, 1996.

[51] Int. Cl.[6] ..... H01Q 1/10; H01Q 1/32

[52] U.S. Cl. ..... 343/903; 343/715; 343/906

[58] Field of Search ..... 343/903, 715, 343/713, 901, 702, 906

[56] References Cited

U.S. PATENT DOCUMENTS

| | | | |
|---|---|---|---|
| 2,635,186 | 4/1953 | Schmidt . | |
| 2,758,151 | 8/1956 | Spector et al. . | |
| 4,742,360 | 5/1988 | Carolus et al. | 343/903 |
| 4,847,629 | 7/1989 | Shimazaki | 343/901 |
| 4,860,024 | 8/1989 | Egashira | 343/702 |
| 4,862,182 | 8/1989 | Egashira | 343/702 |
| 4,968,991 | 11/1990 | Yamazaki | 343/715 |
| 4,987,422 | 1/1991 | Ryan | 343/713 |
| 5,025,263 | 6/1991 | Okamoto et al. | 343/715 |
| 5,072,230 | 12/1991 | Taniyoshi et al. | 343/715 |
| 5,142,294 | 8/1992 | Smith | 343/903 |
| 5,142,295 | 8/1992 | Dourson | 343/903 |
| 5,189,435 | 2/1993 | Yarsunas et al. | 343/903 |
| 5,235,344 | 8/1993 | Shinkawa et al. | 343/903 |
| 5,414,436 | 5/1995 | Shinkawa et al. | 343/715 |
| 5,714,958 | 2/1998 | Rudisill | 343/702 |

*Primary Examiner*—Don Wong
*Assistant Examiner*—Hoang Nguyen
*Attorney, Agent, or Firm*—Roland A. Fuller, III

[57] ABSTRACT

An antenna apparatus includes electrical contacts which each have a sliding mast contact portion and a docking contact portion. The apparatus includes a linearly extendable and retractable one-piece mast antenna. The sliding mast contact portions of the electrical connectors make contact with an outer surface of the mast antenna along the full length of the antenna as it is extended and retracted. The docking contact portions of each electrical connector make electrical contact only with a lower end portion of the antenna which has a larger diameter than the remainder of the antenna. The docking contact portions of each electrical connector only make electrical contact with the lower end portion when the antenna is substantially completely extended. In this manner the docking contact portions experience only a small degree of the wear experienced by the sliding mast contact portions, which make contact with the outer surface of the antenna along almost its entire length. The docking contact portions of each electrical contact used in the apparatus help ensure that good electrical contact is made with the antenna when the antenna is fully extended.

9 Claims, 2 Drawing Sheets

ONE PIECE MAST POWER ANTENNA HAVING ELECTRICAL CONTACT WITH SLIDING AND DOCKING CONTACT PORTIONS

This application is a U.S. patent application based on U.S. Provisional Patent Application Ser. No. 60/020,414 filed Jun. 25, 1996, priority to which is claimed.

1. TECHNICAL FIELD

This invention relates to antenna apparatuses, and more particularly to a one-piece mast antenna incorporating electrical contacts each having portions which make sliding contact with only a small length of the mast antenna at a lower end of the mast antenna when the mast antenna is substantially fully extended.

2. DISCUSSION

In automotive vehicle applications, it is often desirable to make use of a retractable radio frequency antenna. Such antennas are retracted when the ignition of the vehicle is turned off or when a radio in the vehicle is turned off, so that the antenna is concealed within the body of the vehicle when the vehicle or the radio is not in use.

Many retractable antennas are of the telescoping variety. In this design the antenna incorporates several independent lengths of different diameter which are retracted within one another when the antenna is retracted. One drawback with telescoping antennas, however, is that these types of antennas are somewhat susceptible to breakage if the vehicle is driven through an automated car wash while the antenna is in its extended position. Breakage can also occur if an object strikes the antenna while it is extended, since telescoping antennas are generally not very resilient.

One attempt to provide an antenna which is more resistant to breakage has involved implementing wire-wound, flexible one-piece mast antennas which are linearly extendable and retractable via some suitable electrically powered motor. An example of one such device is disclosed in U.S. Pat. No. 5,414,436, entitled "Electric Extensible Car Antenna". The apparatus of this patent makes use of a metallic, one-piece mast antenna which is linearly extended and retracted by a mechanism mounted so as to be concealed within a portion of a vehicle body. As the one-piece mast antenna is extended, an electrical contact element rides along an exterior surface of the one-piece mast to make continuous electrical contact with the mast as the mast is being extended from its retracted position, as well as being retracted from its extended position. Since the one-piece mast antenna is typically about one meter in length, each cycle of extension and retraction places about two meters of travel (i.e., wear) on the electrical contacts which ride along the outer surface of the mast antenna. Over the normal life of the vehicle, the antenna can experience thousands of cycles as described above. Exacerbating this wear is dust, dirt and debris sticking to the outer surface of the mast antenna as the antenna is withdrawn and extended. Such contaminants significantly accelerate the wear of the contacts over repeated cycles of extension and retraction. In the event that the electrical contacts that ride along the outer surface of the one-piece mast should become unacceptably worn, the radio frequency reception provided by the mast antenna could be degraded.

In view of the above, it would be highly desirable to provide some means by which electrical contact can be made with an outer surface of the one-piece mast antenna only when the antenna is substantially fully extended. This would eliminate the great majority of the wear and tear which would otherwise be experienced if the electrical contacts are required to physically ride against the outer surface of the one-piece mast antenna for almost the full length of the antenna as it is extended and retracted. Such an electrical contact arrangement would therefore experience only a very small percentage of the wear that would be experienced by the contacts which slide along the full length of the outer surface of the mast antenna and would also help to ensure excellent radio frequency reception whenever the mast antenna is in its fully extended position. Such an arrangement would also serve to ensure that even if the electrical contacts which slide along the full length of the mast antenna become excessively worn, satisfactory radio frequency reception will still be obtained.

It is therefore a principal object of the present invention to improve upon the one-piece mast antenna of U.S. Pat. No. 5,414,436 by providing a one-piece mast antenna apparatus having an electrical contact which includes a contact portion for sliding along the full length of the outer surface of the mast antenna while the antenna is being extended or retracted, as well as a contact portion adapted to engage with an outer surface of the antenna only when the antenna is substantially fully extended.

It is another object of the present invention to provide a one-piece mast antenna in which an integrally formed electrical contact is provided which includes a mast contact portion for sliding along the full length of the outer surface of the mast antenna while the antenna is being retracted and extended, as well as a docking contact portion which contacts only a small area at a lower end of the mast antenna when the antenna is substantially fully extended.

It is also an object of the present invention to provide a one-piece mast antenna which requires little or no modification to existing one-piece mast antenna systems to provide a docking contact area where electrical contact is made with a docking contact portion of an electrical contact of the antenna only when the antenna is in its substantially fully extended orientation.

It is a further object of the present invention to provide an extendable and retractable one-piece mast antenna apparatus which incorporates an electrical contact having a sliding mast portion for sliding along an outer surface of the mast antenna, and a docking contact portion for contacting only a small area at a lower end of the mast antenna only when the antenna is fully extended which further does not add appreciably to the overall cost or complexity of manufacture of the antenna assembly, and which enhances the reliability of the one-piece mast antenna system.

SUMMARY OF THE INVENTION

The above and other objects are provided by a one-piece mast antenna apparatus in accordance with preferred embodiments of the present invention. A one-piece mast antenna is provided which is extended and retracted by a motor driven gear. In the retracted position the antenna is almost completely concealed within an interior area of the vehicle. In its extended position the mast antenna extends outwardly from an outer body surface of the vehicle to provide radio frequency reception for an AM/FM radio in the vehicle. The antenna apparatus includes at least one electrical contact having a sliding mast contact portion. The electrical contact is held closely adjacent an outer surface of the mast antenna by a contact holder. The sliding mast contact portion of the electrical contact slides along substantially the entire length of the outer surface of the mast antenna as the antenna is extended and retracted to ensure radio frequency reception while the antenna is being extended and retracted. The improvement comprises the electrical contact also having a docking contact portion that makes physical contact with a lower portion of the mast antenna only when the mast antenna becomes substantially fully extended; no physical contact is made with the mast antenna until the antenna is almost completely fully extended. In this manner the docking contact portion experiences only a very small fraction of the normal wear and tear experienced by the sliding mast contact portion. The docking contact portion thus ensures that even if the sliding contact portion becomes significantly worn to the point where radio frequency reception might be degraded, another contact area exists which ensures that radio frequency reception will be provided when the mast antenna is in its fully extended position.

In the preferred embodiments the one-piece antenna apparatus incorporates a pair of electrical contacts. Each electrical contact is integrally formed and includes a slightly curved portion at a first end, which forms the docking contact portion, and a sliding mast contact portion at a second end. The docking contact portion is formed so as to be slightly offset from the sliding mast contact portion when the electrical contact is inserted within the contact holder of the antenna apparatus so as not to rub against the outer surface of the mast antenna while the antenna is being extended and retracted. The lower end portion of the mast antenna is coupled to a drive cable for retracting and extending the mast antenna by an electrically conductive member having an enlarged diameter. When the mast antenna is substantially fully extended, the enlarged diameter of the electrically conductive member contacts the docking contact portion of each electrical contact to ensure satisfactory electrical contact with the mast antenna when the antenna is in its fully extended position. Since the docking contact portions only experience physical contact with the electrically conductive member when the mast antenna is in its substantially fully extended position, the wear and tear experienced by the docking contact portions is only a very small fraction of that experienced by the sliding mast contact portions.

The electrical contacts incorporated in the antenna apparatus of the present invention are low in cost, do not add appreciably to the complexity of manufacture of the antenna apparatus or to its overall cost. The dual contact areas of the electrical contacts incorporated in the antenna apparatus thus provide a low cost means for ensuring excellent electrical contact with the outer surface of the mast antenna when the antenna is fully extended.

BRIEF DESCRIPTION OF THE DRAWINGS

The various advantages of the present invention will become apparent to one skilled in the art by reading the following specification and subjoined claims and by referencing the followings drawings in which:

DETAILED DESCRIPTION OF THE PREFERRED EMBODIMENTS

Figure 1:
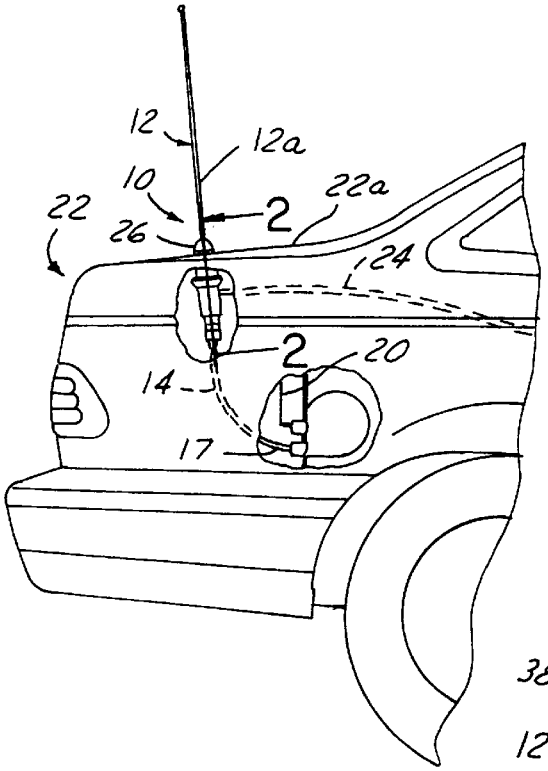
FIG. 1 is a cut away fragmentary view of a portion of a vehicle showing the antenna apparatus of the present invention positioned within a rear area of the vehicle.

Referring to FIG. 1, there is shown an antenna apparatus 10 in accordance with a preferred embodiment of the present invention. The antenna apparatus generally includes a one-piece, flexible, mast antenna 12 coupled to a drive cable 14, and a mechanism 16 for retracting and extending the mast antenna 12. Typically the drive cable 14 is enclosed within a hollow plastic sheath 17. The mechanism 16 receives electrical power and control signals via an electrical cable 20. Radio frequency (RF) signals are conducted from the antenna 12 to a radio (not shown) in the interior area of a vehicle 22 by a coaxial cable 24. The antenna 12 may vary in length, but is preferably in the range of about one meter, more particularly about 0.8 meter in length, and therefore extends from an outer body surface 22*a* of the vehicle 22 by about 0.8 meter when in its fully extended position. Accordingly, it will be appreciated that each cycle (i.e., extension and retraction) of the mast antenna 12 results in about 1.6 meters of travel of the mast antenna. When retracted by the mechanism 16, only a very small portion of the antenna 12 extends above the outer body surface 22*a*. As will be appreciated, then, an outer surface 12*a* of the antenna 12 is exposed to dust, dirt, debris and other contaminants during normal use of the vehicle 22. When the antenna 12 is retracted, typically when the vehicle radio is turned off and/or when the vehicle ignition is turned off, the majority of the dust and dirt on the outer surface 12*a* of the antenna is removed by a seal (not shown) disposed within a base portion 26 of the antenna apparatus 10 which is mounted to the outer body surface 22*a*. However, very small dust and dirt particles adhered to the outer surface 12*a*, which are not removed from the outer surface by the base member 26, may come into contact with various components within the antenna apparatus 10 when the mast antenna 12 is withdrawn into its retracted position.

Figure 2:
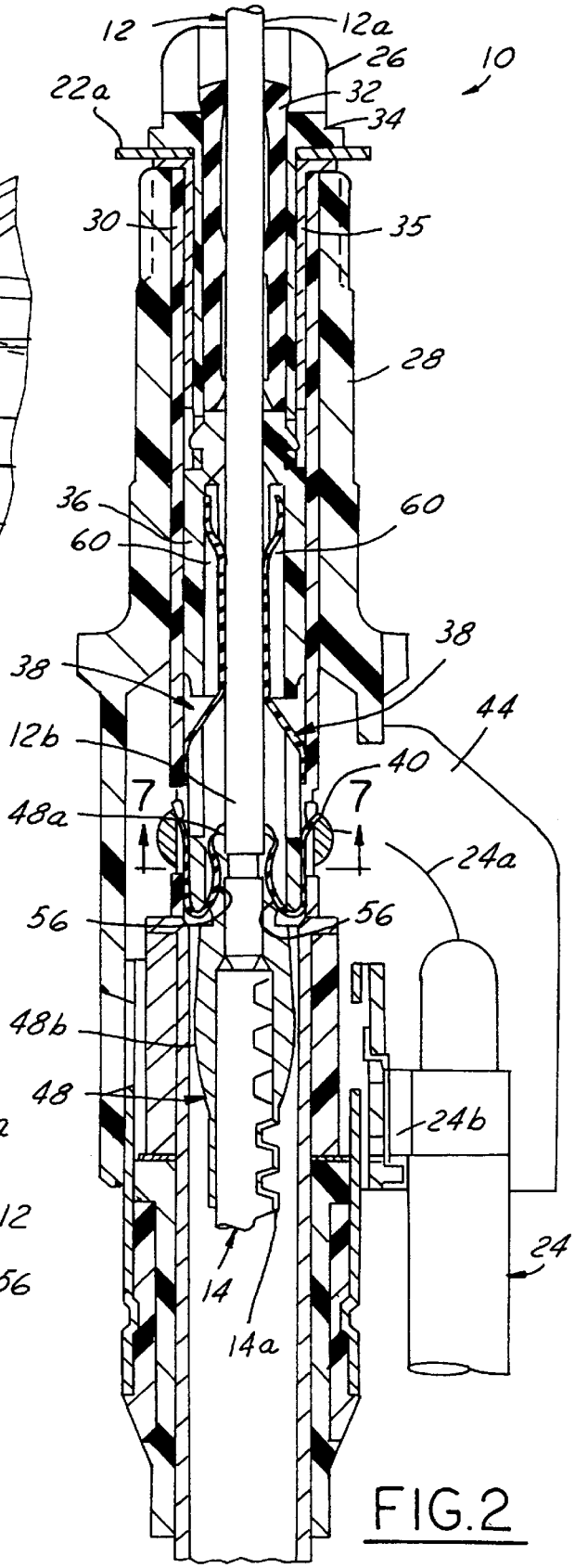
FIG. 2 is a cross sectional side view of a portion of the antenna apparatus showing a pair of electrical contacts, wherein each electrical contact includes a sliding mast contact portion and a docking contact portion, with the docking contact portion being in electrical contact with an electrically conductive ferrule used to secure the mast antenna to a drive cable.

Referring now to FIG. 2, there is shown a portion of the antenna apparatus 10 illustrating various components thereof. Initially, it should be understood that the antenna apparatus 10 is substantially similar this invention is an improvement upon the antenna apparatus disclosed in U.S. Pat. No. 5,414,436, issued on May 9, 1995, assigned to Harada Kogyo Kabushiki Kaisha, Tokyo, Japan, and the disclosure of this patent is hereby incorporated by reference. Apparatus 10 of the present invention represents an improvement over the apparatus disclosed in the just-mentioned patent by providing a means to insure that excellent electrical contact is made with the antenna 12 when the antenna is in its fully extended position.

With further reference to FIG. 2, the antenna apparatus 10 includes a base casting 28 within which is disposed an insulator. Within the insulator 30 is a seal 32 which encloses the one-piece mast antenna 12. The antenna 12 rubs along the seal 32 as the antenna 12 is extended and retracted to remove much of the abrasive dust and dirt particles which have accumulated on the outer surface 12*a* of the antenna 12. The seal 32 is enclosed within a seal holder 34, which also fits partially within the insulator 30. A damper 35 also circumscribes a portion of the seal holder 34 which helps dampen oscillation of the antenna 12 when the antenna is retracted.

With further reference to FIG. 2, a contact holder 36 is disposed coaxially within the insulator 30 and holds a pair of electrical contacts 38 in close proximity to the outer surface 12*a* of the antenna 12. The electrical contacts 38 are in electrical contact with an electrically conductive ring 40, which is in turn coupled to a conductor 24*a* of the coaxial cable 24. The braided sheath 24*b* of the coaxial cable 24 is grounded to the base casting 28. A portion of the conductor 24*a* and braided sheath 24*b* are enclosed within plastic fill material 44 during assembly of the apparatus 10.

With further reference to FIG. 2, a lower end portion 12*b* of the mast antenna 12 is encased within a metallic ferrule 48. The ferrule 48 has a head portion 48*a* which encases the lower end portion 12*b* of the mast antenna 12 and a slug portion 48*b* which encases a portion of the drive cable 14. The ferrule 48 is preferably press fit onto the lower end portion 12*b* of the antenna 12. The drive cable 14 can be seen to include a plurality of teeth 14*a* which engage a gear within the mechanism 16 (FIG. 1) which allows the drive cable 14 to be retracted and extended by a motor driven gear within the mechanism 16. The drawing of FIG. 2 shows the lower end 12*b* of the mast antenna 12 when the antenna 12 is fully extended.

With brief reference to FIGS. 3–6, one of the electrical connectors 38 is shown in greater detail. With specific reference to FIGS. 3 and 4, the connector 38 includes a first end portion 50, a coupling portion 52 and a second end portion 54. The first end portion 50 includes a docking contact portion 56 which takes the form of a slightly curved portion which is bent or rolled under a section of the coupling portion 52. The coupling portion 52 includes a tab 58 which is electrically coupled to the conductive ring 40 (FIG. 2). The second end portion 54 includes a sliding mast contact portion 60 and a pair of biasing portions 62 disposed on opposite sides of the sliding mast contact portion 60. From FIGS. 3 and 6, it can be seen that the docking contact portion 56 is slightly offset from the sliding mast contact portion 60. The electrical contact 38 is made from metal or any other suitable electrically conductive material which has a slight degree of resiliency.

Figure 7:
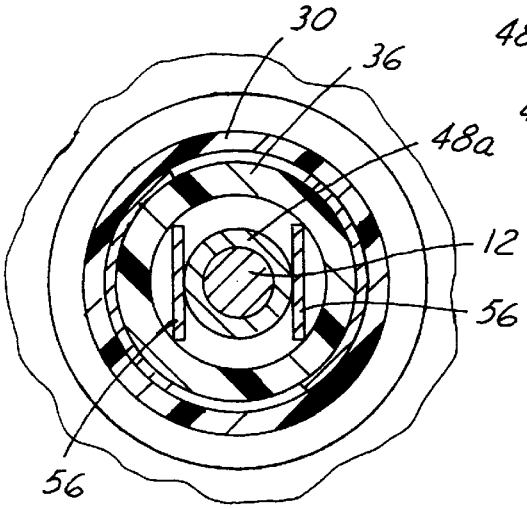
FIG. 7 is a cross sectional view of the electrical contacts in physical contact with a portion of the ferrule, in accordance with section line 7—7 in FIG. 2.
Figure 3:
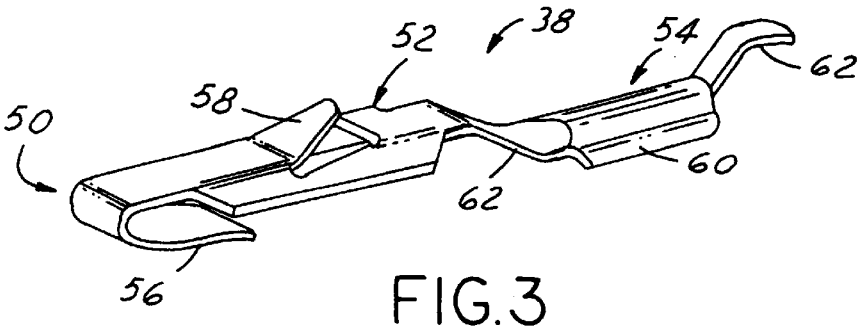
FIG. 3 is a perspective view of the electrical contact incorporated in the mast antenna of the present invention.
Figure 4:
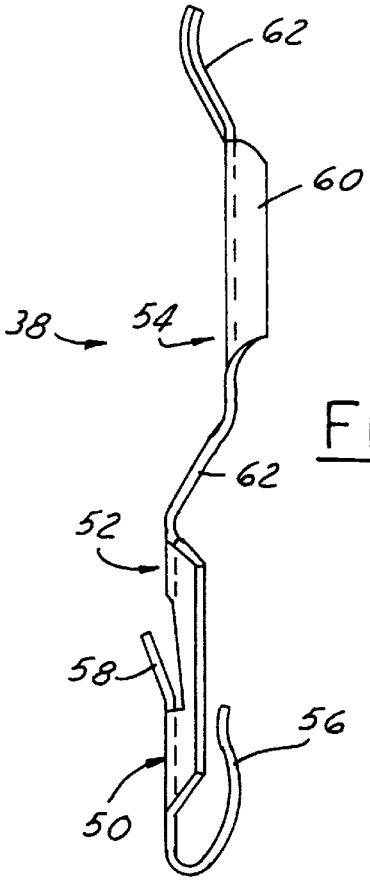
FIG. 4 is a side view of the electrical contact of FIG. 3.
Figure 5:
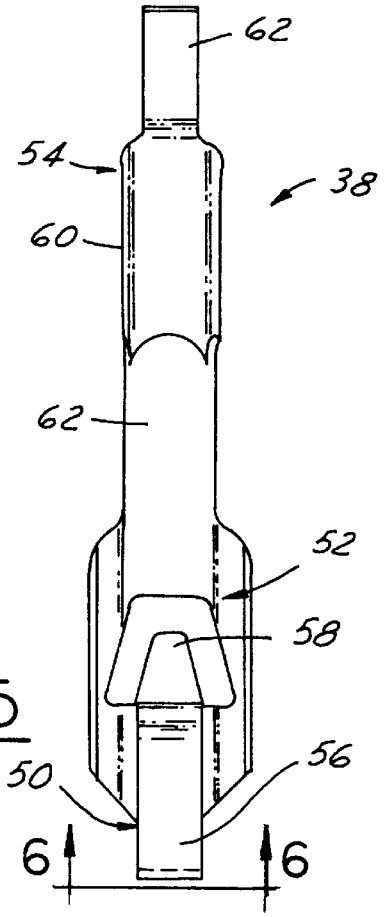
FIG. 5 is a plan view of the electrical contact of FIG. 3.
Figure 6:
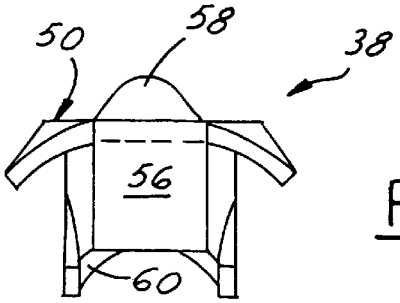
FIG. 6 is an end view of the electrical contact in accordance with directional line 6—6 in FIG. 5 illustrating the degree of offset between the docking contact portion and the sliding mast contact portion.

With reference to FIGS. 2, 3 and 7, when the mast antenna 12 is being retracted or withdrawn, the sliding mast contact portion 60 rides along the outer surface 12*a* of the antenna 12. This enables RF reception while the antenna 12 is moving between its extended and retracted positions. As explained previously herein, however, the sliding mast contact portion 60 experiences wear from the relatively long travel (i.e., about 1.6 meters) each time the antenna 12 is cycled from a retracted to an extended position and back to its retracted position. Additional wear may be experienced because of abrasive dust and dirt particles on the outer surface 12*a* of the antenna 12 which escape removal by the seal 32. When the antenna 12 is in its fully extended position, however, as shown in FIGS. 2 and 7, the head portion 48*a* of the ferrule 48 at the lower end 12*b* of the antenna 12 makes electrical contact with the docking contact portions 56 of each electrical contact 38. This contact between the ferrule 48 and the docking contact portions 56 of each electrical contact 38 is further made only when the antenna 12 is substantially fully extended. Accordingly, the docking contact portions 56 experience only a very small degree of sliding contact with the ferrule head portion 48*a* when compared to the length of sliding contact of the mast contact portions 60 of each connector 38, which slide along almost the entire length of the antenna 12.

From FIGS. 2 and 7 it will also be apparent that the antenna 12 has an outer diameter which is less than the outer diameter of the ferrule 48 at the lower end 12*b* of the antenna. This, together with the slight degree of offset of the docking contact portion 56 of each electrical contact 38 relative to the sliding mast contact portion 60, ensures that the docking contact portion 56 of each electrical contact 38 only makes contact with the ferrule head portion 48*a* and not with the outer surface 12*a* of the antenna 12 during extension and retraction of the antenna 12.

The electrical contacts 38 of the present invention thus provide a means by which electrical contact can be made with the mast antenna 12 only along a very limited length of travel of the mast antenna 12, and essentially only when the antenna is in its substantially fully extended position. In this manner the docking contact portions 56 do not ride along the full length of the outer surface 12*a*, or any other metallic surface, during extension and retraction of the antenna 12, and therefore do not suffer the degree of wear experienced by the sliding mast contact portion 60 of each contact 38. Thus, even if one or both of the mast contact portions 60 become worn to the point of not making good electrical contact with the outer surface 12*a* of the antenna 12, the docking contact portions 56 will still make electrical contact with the ferrule 48 when the antenna 12 is in its fully extended position. This serves to help ensure that good RF reception can be provided by the antenna 12 when the antenna is in its fully extended position. The press fit of the ferrule 48 onto the lower end portion 12*b* of the antenna 12 serves to ensure that intermittence due to rattle will be avoided.

The electrical contacts 38 of the present invention further are relatively simple to construct, do not add appreciably to the overall cost of the antenna apparatus 10 or to its complexity of manufacture. The electrical contacts 38 further can be implemented into existing one-piece mast antenna assemblies with only slight modifications to such existing assemblies. The electrical contacts 38 serve to assure that even over prolonged use of the antenna apparatus 10, excellent electrical contact can be maintained with the outer surface 12*a* of the antenna 12 when the antenna 12 is in its fully extended position. It will be appreciated, however, that while the preferred embodiments of the present invention are directed to an apparatus for use with an AM/FM radio, that the teachings presented herein could be applied to a wide variety of antenna apparatuses if desired with little or no modification.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. In a one-piece mast antenna apparatus having an electrically conductive, one-piece mast antenna with an elongated portion having a first diameter and a lower end portion having a second diameter which is larger than said first diameter, a contact holder for holding at least one electrical contact adjacent said mast antenna when said mast antenna is extended and retracted, at least one electrical contact disposed within said contact holder so as to be positioned closely adjacent said mast antenna, and said electrical contact including a mast contact portion adapted to make continuous sliding contact with said mast antenna as said mast antenna is extended and retracted, the improvement comprising:

a docking contact portion adapted to contact said lower end of said mast antenna only after said mast antenna is substantially fully extended, said docking contact portion of said electrical contact remaining out of electrical contact with said elongated portion of said mast antenna when said mast antenna is being extended and retracted.

2. The improvement of claim 1, wherein said apparatus includes a pair of electrical contacts disposed within said contact holder.

3. The improvement of claim 1, wherein said lower end of said mast antenna is secured to a ferrule; and wherein said ferrule has a diameter equal to said second diameter and is electrically conductive; and wherein said docking portion of said electrical contact is urged into sliding engagement with an outer surface of said ferrule only after said mast antenna becomes substantially fully extended.

4. The improvement of claim 1 wherein said electrical contact comprises an integrally formed member having a coupling portion, a first end portion rolled into a curved length to form said docking contact portion, and a second end portion, said docking contact portion offset from said second end portion when said electrical contact is secured in said contact holder.

5. In an antenna apparatus having a one-piece, electrically conductive mast antenna and a mechanism for linearly withdrawing and extending said mast antenna, an electrical contact for electrically communicating a radio frequency signal received by said mast antenna to a length of electrical cabling associated with said vehicle, said electrical contact including a coupling portion for electrically coupling said electrical contact to said electrical cabling, the improvement comprising:

a first end portion rolled into a curved length to form a docking contact portion;

a second end portion forming a sliding mast contact portion; and said docking contact portion being formed so as to be offset from said sliding mast contact portion when said electrical contact is secured within said antenna apparatus; and wherein said sliding mast contact portion operates to make continuous sliding contact with an elongated mast portion of said mast antenna and said docking contact portion only makes contact with an enlarged, lower end portion of said mast antenna when said mast antenna is substantially fully extended.

6. In one-piece mast antenna apparatus adapted to be linearly retracted and extended, said antenna apparatus including a one-piece mast antenna having an elongated mast portion with a first diameter and a lower end portion having a second diameter larger than said first diameter, a contact holder adapted to hold a pair of electrical contacts closely adjacent said mast antenna, the improvement comprising:

a pair of electrical contacts disposed within said contact holder so as to be held against said mast antenna, each of said electrical contacts comprising:

an integrally formed member having a docking contact portion and a sliding mast contact portion, said docking contact portion being offset from said sliding mast contact portion when said electrical contact is positioned within said contact holder;

said sliding mast contact portion operating to make continuous electrical contact with an outer surface of said elongated mast portion of said mast antenna when said mast antenna is being extended and retracted, and said docking contact portion operating to contact only said lower end portion of said mast antenna when said mast antenna is substantially fully extended.

7. The improvement of claim 6, wherein said docking contact portion comprises an end portion of said electrical contact which is rolled to form a semi-circular portion which is spaced apart from said elongated portion of said mast antenna when said electrical contact is secured within said contact holder, but which contacts said lower end portion of said mast antenna when said mast antenna is substantially fully extended.

8. In an extendable and retractable one-piece mast antenna, an improved electrical contact for electrically transmitting radio frequency signals received by said one-piece mast antenna to electrical cabling, said improvement comprising:

said electrical contact comprising an integrally formed member having a docking contact portion, a coupling portion for electrically coupling said electrical contact with said electrical cabling and a sliding mast contact portion;

said sliding mast contact portion operating to contact an elongated portion of said mast antenna as said mast antenna is linearly withdrawn and extended; and said docking contact portion of said electrical contact operating to electrically contact only a lower end portion of said mast antenna when said mast antenna is substantially fully extended.

9. The electrical contact of claim 8, further comprising a contact holder for supporting said electrical contact closely adjacent said mast antenna; and wherein said docking contact portion is offset from said sliding mast contact portion when said electrical contact is positioned within said contact holder adjacent said sliding mast.

* * * * *